US011932369B1

(12) United States Patent
Perdomo Tornbaum et al.

(10) Patent No.: US 11,932,369 B1
(45) Date of Patent: Mar. 19, 2024

(54) DEVICES AND METHODS OF MAKING DEVICES FOR COUPLING PROPULSORS TO MARINE VESSELS

(71) Applicant: Brunswick Corporation, Mettawa, IL (US)

(72) Inventors: Andres Perdomo Tornbaum, Neenah, WI (US); Tom Geng, Wuxi (CN); Steven Lu, Suzhou (CN); Matthew Z. Seta, Fond du Lac, WI (US); Jeremy J. Kraus, Mt. Calvary, WI (US); Keith W. Schmidt, Stillwater, OK (US); James E. Erickson, Fond du Lac, WI (US); Ronald L. Hall, Stillwater, OK (US); Derek J. Fletcher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/378,383

(22) Filed: Jul. 16, 2021

Related U.S. Application Data

(63) Continuation of application No. 17/185,289, filed on Feb. 25, 2021, now Pat. No. 11,572,146.

(51) Int. Cl.
*B63H 21/21* (2006.01)
*B63B 1/12* (2006.01)
(Continued)

(52) U.S. Cl.
CPC ..... *B63H 21/21* (2013.01); *B63B 1/125* (2013.01); *B63B 35/38* (2013.01); *B63B 79/10* (2020.01);
(Continued)

(58) Field of Classification Search
CPC ..... B63H 21/21; B63H 1/14; B63H 21/12; B63H 23/04; B63H 2005/1258;
(Continued)

(56) References Cited

U.S. PATENT DOCUMENTS 2,213,520 A 9/1940 Gentry
3,236,202 A 2/1966 Quady et al.
(Continued)

FOREIGN PATENT DOCUMENTS

EP 1611007 8/2007
EP 1914161 4/2008
(Continued)

OTHER PUBLICATIONS

International Search Report and Written Opinion for International Application No. PCT/CA/2016/050308 dated Jun. 9, 2016.
(Continued)

*Primary Examiner* — Andrew Polay
(74) *Attorney, Agent, or Firm* — Andrus Intellectual Property Law, LLP

(57) ABSTRACT

A device for coupling a propulsor to a marine vessel. The device includes a mounting bracket configured for attachment to the marine vessel. A support frame has a carriage and is configured for the propulsor to be coupled thereto, where the carriage is configured to slidably engage with the mounting bracket into a fixed position. A member is manually engageable to prevent the carriage from sliding out of the fixed position. The propulsor is coupled to the marine vessel by sliding the carriage into the fixed position and engaging the member, where the propulsor is operable to propel the marine vessel in water when the carriage is in the fixed position, and where the propulsor is configured for
(Continued)

decoupling from the marine vessel by disengaging the member and sliding the carriage out of engagement with the mounting bracket.

19 Claims, 7 Drawing Sheets

(51) Int. Cl.

| | |
|---|---|
| ***B63B 35/38*** | (2006.01) |
| ***B63B 79/10*** | (2020.01) |
| ***B63H 1/14*** | (2006.01) |
| ***B63H 21/12*** | (2006.01) |
| ***B63H 23/04*** | (2006.01) |
| *B63H 20/00* | (2006.01) |

(52) U.S. Cl.
CPC ..... *B63H 1/14* (2013.01); *B63H 21/12* (2013.01); *B63H 23/04* (2013.01); *B63H 20/007* (2013.01)

(58) Field of Classification Search
CPC ..... B63H 2025/425; B63H 20/007; B63H 20/10; B63H 20/106; B63H 20/08; B63B 1/125; B63B 35/38; B63B 79/10; B63B 35/613
See application file for complete search history.

(56) References Cited

U.S. PATENT DOCUMENTS

| | | | | |
|---|---|---|---|---|
| 3,462,102 | A | 8/1969 | Rivers | |
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A | 10/1985 | Philips | |
| 4,734,068 | A | 3/1988 | Edwards | |
| 4,875,656 | A | 10/1989 | Boede | |
| 4,911,398 | A | 3/1990 | Dijulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,195,914 | A | 3/1993 | Binversie et al. | |
| 5,277,630 | A | 1/1994 | Clark | |
| 5,499,792 | A | 3/1996 | Tamiso | |
| 5,595,133 | A | 1/1997 | Bullard | |
| 5,639,272 | A | 6/1997 | Henderson et al. | |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,257,165 | B1 | 7/2001 | Danos et al. | |
| 6,280,267 | B1 | 8/2001 | Griffith, Sr. et al. | |
| 6,325,685 | B1 | 12/2001 | Knight et al. | |
| 6,431,923 | B1 * | 8/2002 | Knight | B63H 25/42 440/6 |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,182,033 | B1 | 2/2007 | Philips et al. | |
| 7,185,599 | B1 | 3/2007 | Griffiths et al. | |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,399,211 | B1 * | 7/2008 | Spaulding | B63H 20/10 440/6 |
| 7,510,450 | B1 | 3/2009 | Dresher | |
| 7,520,239 | B2 | 4/2009 | Bryham | |
| 7,533,622 | B1 | 5/2009 | Jaszewski et al. | |
| 7,753,745 | B2 | 7/2010 | Schey et al. | |
| 7,806,065 | B1 | 10/2010 | Bekker et al. | |
| 7,887,381 | B2 | 2/2011 | Brass et al. | |
| 7,946,243 | B1 | 5/2011 | Ulrich | |
| 8,011,982 | B1 * | 9/2011 | Baier | B63H 20/12 440/53 |
| 8,051,793 | B2 | 11/2011 | Ulgen | |
| 8,123,577 | B2 | 2/2012 | Riggs | |
| 8,479,677 | B2 | 7/2013 | Bolline et al. | |
| 8,814,616 | B2 | 8/2014 | Riggs | |
| 9,108,710 | B1 | 8/2015 | McChesney et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | McClure | |
| 9,969,474 | B1 | 5/2018 | Traux et al. | |
| 10,167,069 | B2 | 1/2019 | Houle et al. | |
| 10,220,926 | B1 | 3/2019 | Pelini | |
| 10,407,131 | B1 | 9/2019 | Ward | |
| 10,850,820 | B1 * | 12/2020 | Minogue | B63H 20/06 |
| 11,591,057 | B2 | 2/2023 | Tornbaum et al. | |
| 11,603,179 | B2 | 3/2023 | Poirier et al. | |
| 11,643,176 | B1 | 5/2023 | Mueller et al. | |
| 2002/0142680 | A1 | 10/2002 | Anderson | |
| 2005/0159053 | A1 | 7/2005 | Ruffe | |
| 2006/0228959 | A1 | 10/2006 | Ruiz | |
| 2007/0232159 | A1 | 10/2007 | Lee | |
| 2008/0190227 | A1 | 8/2008 | Myers et al. | |
| 2009/0227158 | A1 | 9/2009 | Bernloehr et al. | |
| 2010/0032545 | A1 | 2/2010 | Bernloehr et al. | |
| 2010/0116967 | A1 | 5/2010 | Todd et al. | |
| 2010/0136857 | A1 | 6/2010 | Goudsmit | |
| 2012/0097086 | A1 | 4/2012 | Sancoff | |
| 2014/0158037 | A1 | 6/2014 | George | |
| 2015/0201548 | A1 | 7/2015 | Wolter et al. | |
| 2015/0259033 | A1 | 9/2015 | George et al. | |
| 2016/0001865 | A1 | 1/2016 | Bernloehr et al. | |
| 2017/0203823 | A1 | 7/2017 | Abney | |
| 2017/0341718 | A1 | 11/2017 | Zimmerman | |
| 2018/0057130 | A1 * | 3/2018 | Houle | B63H 20/06 |
| 2018/0208286 | A1 * | 7/2018 | MacFarlane | B63B 32/10 |
| 2018/0334233 | A1 | 11/2018 | Vance | |
| 2019/0217921 | A1 | 7/2019 | Shibayama et al. | |
| 2021/0354803 | A1 | 11/2021 | Christensen et al. | |
| 2021/0380210 | A1 | 12/2021 | Fishburn et al. | |
| 2022/0266968 | A1 | 8/2022 | Tornbaum et al. | |

FOREIGN PATENT DOCUMENTS

| | | |
|---|---|---|
| EP | 2757037 | 7/2014 |
| EP | 2242678 | 11/2015 |
| EP | 2246252 | 5/2019 |
| GB | 2554045 | 3/2018 |
| JP | 2013100013 | 5/2013 |

OTHER PUBLICATIONS

Tornbaum, Andres Perdomo, "Methods for a Marine Vessel with Primary and Auxiliary Propulsion Devices," Unpublished U.S. Appl. No. 16/984,617, filed Aug. 4, 2020 (specification and drawings only).

Owerboat Television, "How to make docking a pontoon boat easy with a retractable SideShift Thruster | My Boat DIY", YouTube video, Jun. 1, 2020, available at https://www.youtube.com/watch?v=2NBx-Vnl3Kk.

Sideshift Inc., "Sideshift Dock Like a Pro PT230/PT360 Pontoon Thruster System," Installation/Operation Manual, Oct. 2019, vol. 2.4.

* cited by examiner

DEVICES AND METHODS OF MAKING DEVICES FOR COUPLING PROPULSORS TO MARINE VESSELS

CROSS REFERENCE TO RELATED APPLICATION

This application is a continuation-in-part of U.S. patent application Ser. No. 17/185,289, filed Feb. 25, 2021, which is incorporated herein by reference in its entirety.

FIELD

The present disclosure generally relates to devices and methods of making devices for coupling propulsors to marine vessels.

BACKGROUND

The following U.S. Patents provide background information and are hereby incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion device, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion device. An example indicator includes a light operatively coupled to a propulsion device of a watercraft, wherein an operation of the light indicates a status of a thruster system of the propulsion device.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are hereby incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a device for coupling a propulsor to a marine vessel. The device includes a mounting bracket configured for attachment to the marine vessel. A support frame has a carriage and is configured for the propulsor to be coupled thereto, where the carriage is configured to slidably engage with the mounting bracket into a fixed position. A member is manually engageable to prevent the carriage from sliding out of the fixed position. The propulsor is coupled to the marine vessel by sliding the carriage into the fixed position and engaging the member, and where the propulsor is configured for decoupling from the marine vessel by disengaging the member and sliding the carriage out of engagement with the mounting bracket.

The present disclosure further generally relates to a method for making a device for coupling a propulsor to a marine vessel. The method includes configuring a mounting bracket for coupling to the marine vessel and configuring a carriage of a support frame to slide within the mounting bracket, where the carriage is slidable within the mounting bracket into a fixed position. The method further includes configuring the carriage for coupling the propulsor thereto, and configuring a member to be positioned between the carriage and the mounting bracket, the member being manually engageable to prevent the carriage from sliding out of the fixed position. The propulsor is coupled to the marine vessel by sliding the carriage into the fixed position and engaging the member, and where the propulsor is decoupled from the marine vessel by disengaging the member and sliding the carriage out of engagement with the mounting bracket.

BRIEF DESCRIPTION OF THE DRAWINGS

The present disclosure is described with reference to the following drawings.

DETAILED DISCLOSURE

The present disclosure generally relates to propulsion devices for marine vessels, and particularly those having propulsors movable between stowed and deployed positions. The present inventors have recognized problems with propulsion devices presently known in the art, including a risk of damage when the propulsor strikes an underwater object such as a log. These underwater impacts can cause damage to actuators (e.g., those that move the propulsor between the deployed and stowed positions) and other components within the propulsion device more generally. Additionally, the inventors have recognized that propulsors moveable between stowed and deployed positions as presently known in the art do not provide a fail-safe for when the actuator fails. In other words, propulsion devices presently known in the art do not offer operators a mechanism for manually moving the propulsor when the actuator is inoperable, for example due to damage or power loss.

Figure 1:
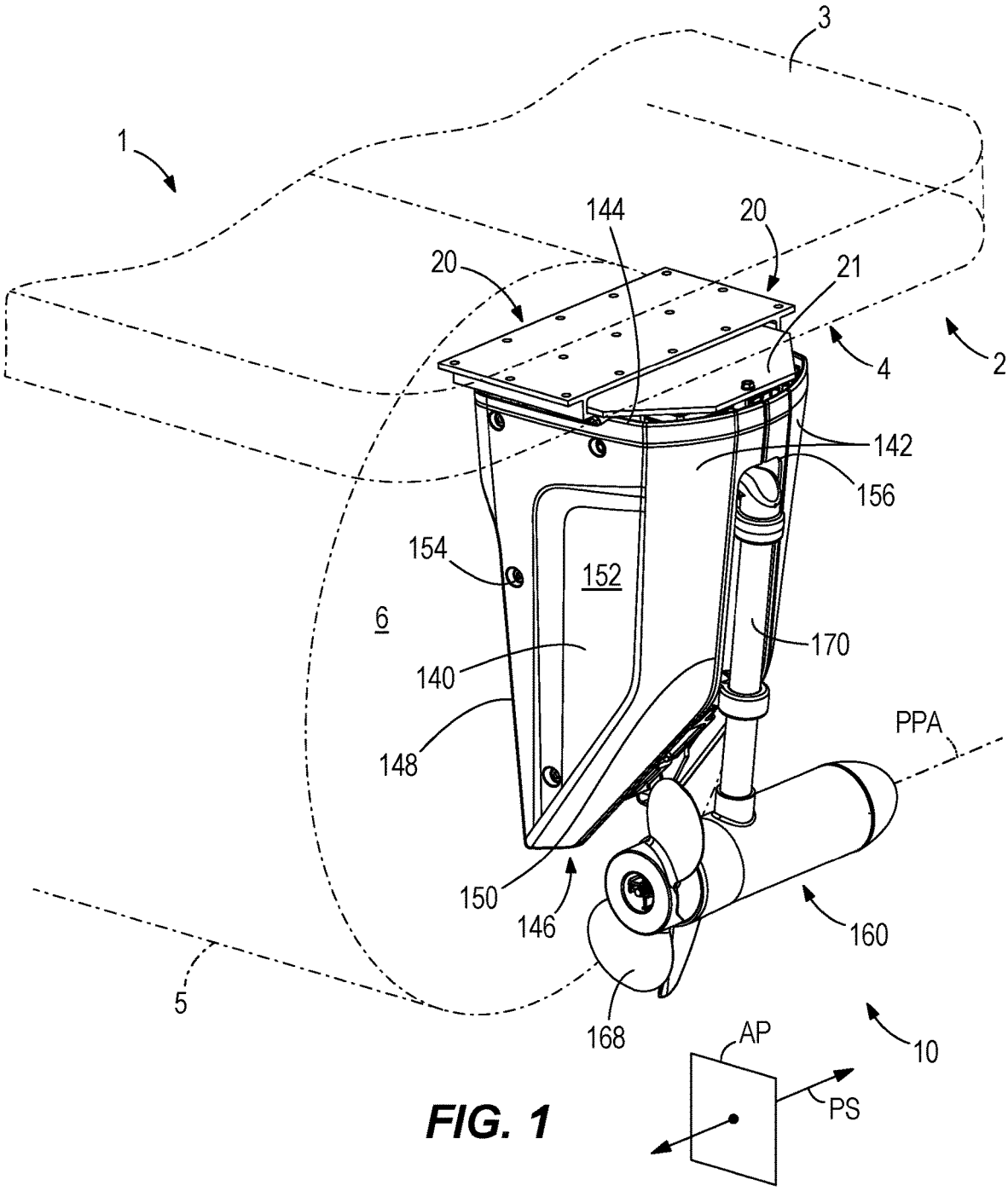
FIG. 1 is a rear perspective view of marine vessel incorporating a device according to the present disclosure with the propulsion device in a stowed position.

FIG. 1 depicts a propulsion device 10 according to the present disclosure, here shown coupled to a marine vessel 1. The marine vessel 1 extends between a bow and a stern 2, as well as between port and starboard sides. The marine vessel 1 has pontoons 5 attached to an underside 4 of a deck 3 in a customary manner. The propulsion device 10 has a base 20 that is coupled to the underside 4 of the deck 3 behind the back 6 of one of the pontoons 5. This positioning shields the propulsion device 10 from water turbulence when the marine vessel 1 is propelled forward other than by the propulsion device 10 (such as an outboard motor as presently known in the art).

As will be discussed further below, the propulsion device 10 includes a shaft 170 with a propulsor 160 coupled thereto. The shaft 170 and propulsor 160 are moveable between a stowed position as presently shown and a deployed position (see FIG. 4). The shaft 170 is moveable within a vertical plane V (FIG. 1) and the propulsor 160 is configured to propel the marine vessel 1 in the water in the port-starboard direction PS when in the deployed position. The propulsor 160 generates a thrust force for moving the marine vessel 1 via rotation of a propeller 168 about a propeller shaft axis PPA in a customary manner (e.g., rotated by an electric motor contained within the body of the propulsor 160 and powered by a battery or other power source). However, it should be recognized that other types of propulsors are also contemplated by the present disclosure, including jet drives or impellers, for example.

The propulsion device 10 of FIG. 1 further includes a cowling 140 formed by two side panels 142. The side panels 142 each extend between a top 144 and a bottom 146, a front 148 and a back 150, and an outside surface 150 opposite an inside surface (not numbered). Openings 154 are defined within the side panels 142 for anchoring the side panels 142 in the positions shown. By way of non-limiting example, a fastener such as a screw or bolt may be inserted through the openings 154 and threaded into a corresponding opening (not shown) in the base 20 of the propulsion device 10, which is partially obscured by the cowling 140. A shaft opening 156 is defined between the side panels 142 of the cowling 140 when assembled, allowing the shaft 170 to move between the stowed and deployed positions without interference by the cowling 140.

Figure 2:
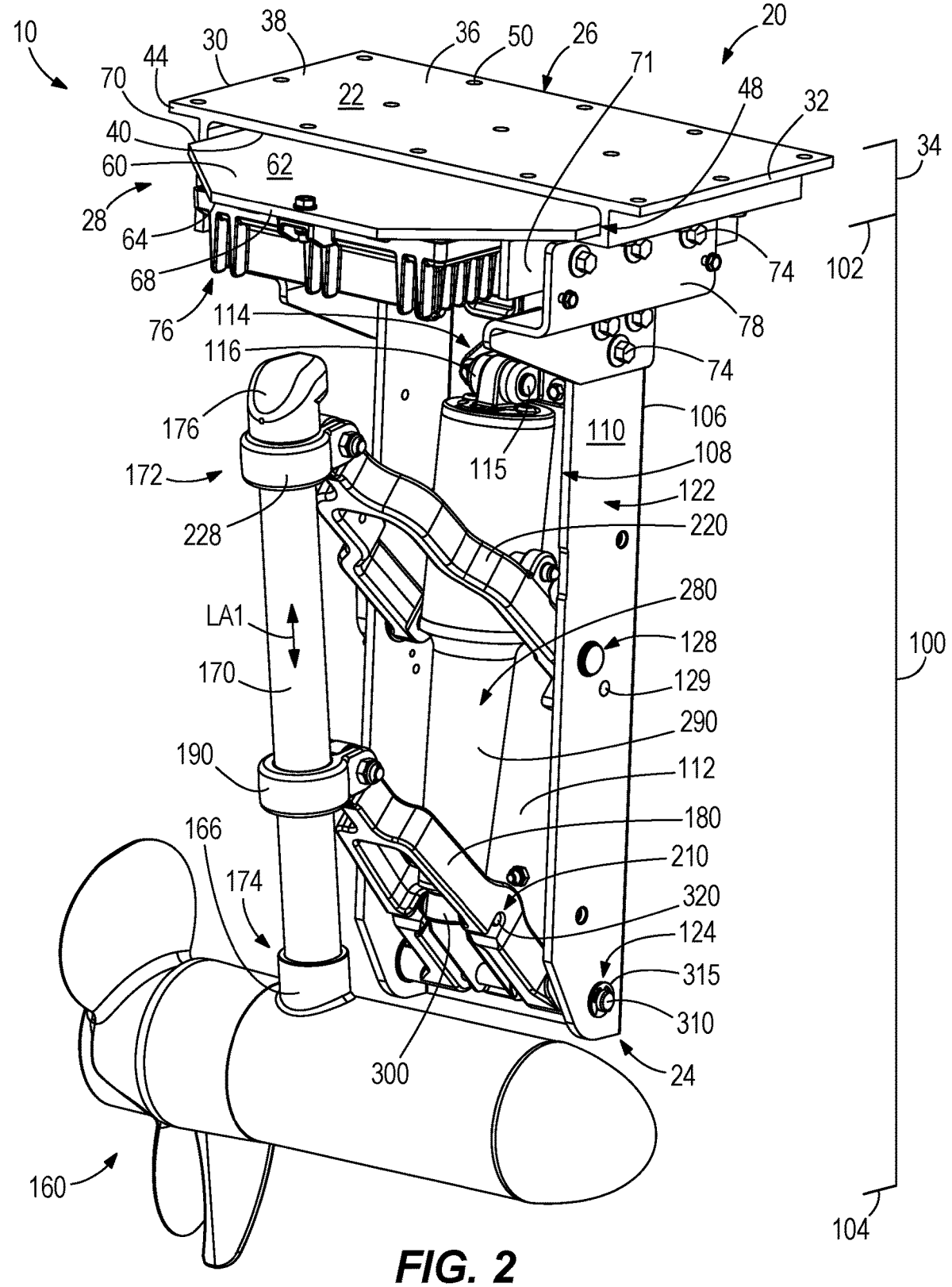
FIG. 2 is a rear perspective view of the device of FIG. 1 with a cowling removed.

FIG. 2. shows an opposing rear view of the propulsion device 10 of FIG. 1 with the cowling 140 removed. As previously discussed, the propulsion device 10 is coupled to the marine vessel 1 via a base 20. The base 20 extends between a top 22 and a bottom 24, a front 26 and a back 28, and a left 30 and a right 32. The base 20 generally divided into a first portion 34 and a second portion 100. The first portion 34 includes a mounting bracket 36 having a top 38 and a bottom 40, as well as a C-channel 48 extending downwardly from the top 38 that runs from the front 26 to the back 28 of the base 20. Openings 50 are provided through the mounting bracket 36 for coupling the first portion 34 to the marine vessel 1, for example via fasteners such as nuts and bolts or screws.

The mounting bracket 36 is configured to receive and support a carriage 60 therein. The carriage 60 extends between a top 62 and a bottom 64 with sides 70 therebetween configured to correspond with the C-channels 48 of the mounting bracket 36. The carriage 60 is received within the opposing C-channels 48 by inserting from the back 34 of the mounting bracket 36. A back 68 of the carriage 60 need not be received within the mounting bracket 36.

Figure 6:
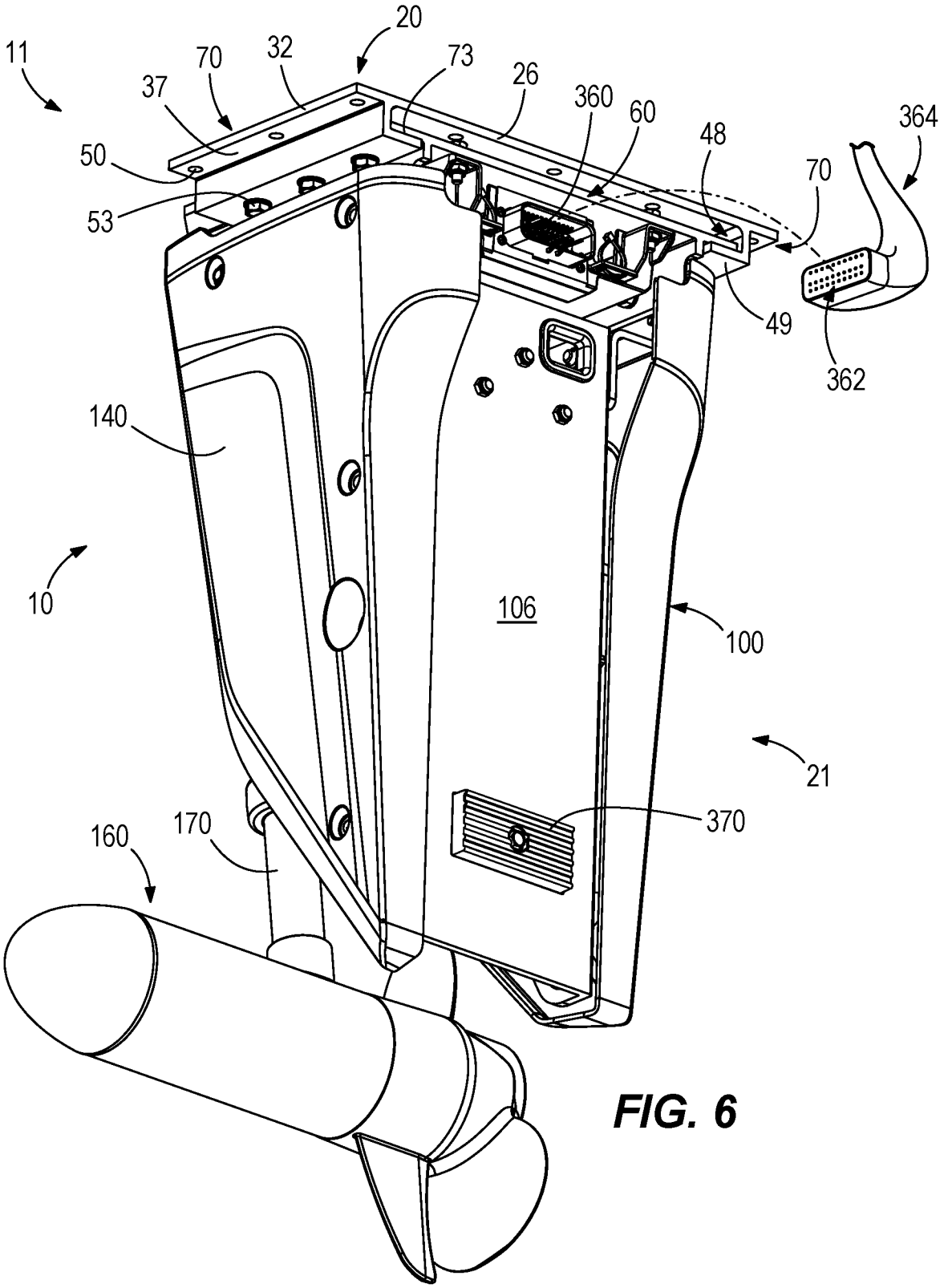
FIG. 6 is a front perspective view of the embodiment of FIG. 4.
Figure 7:
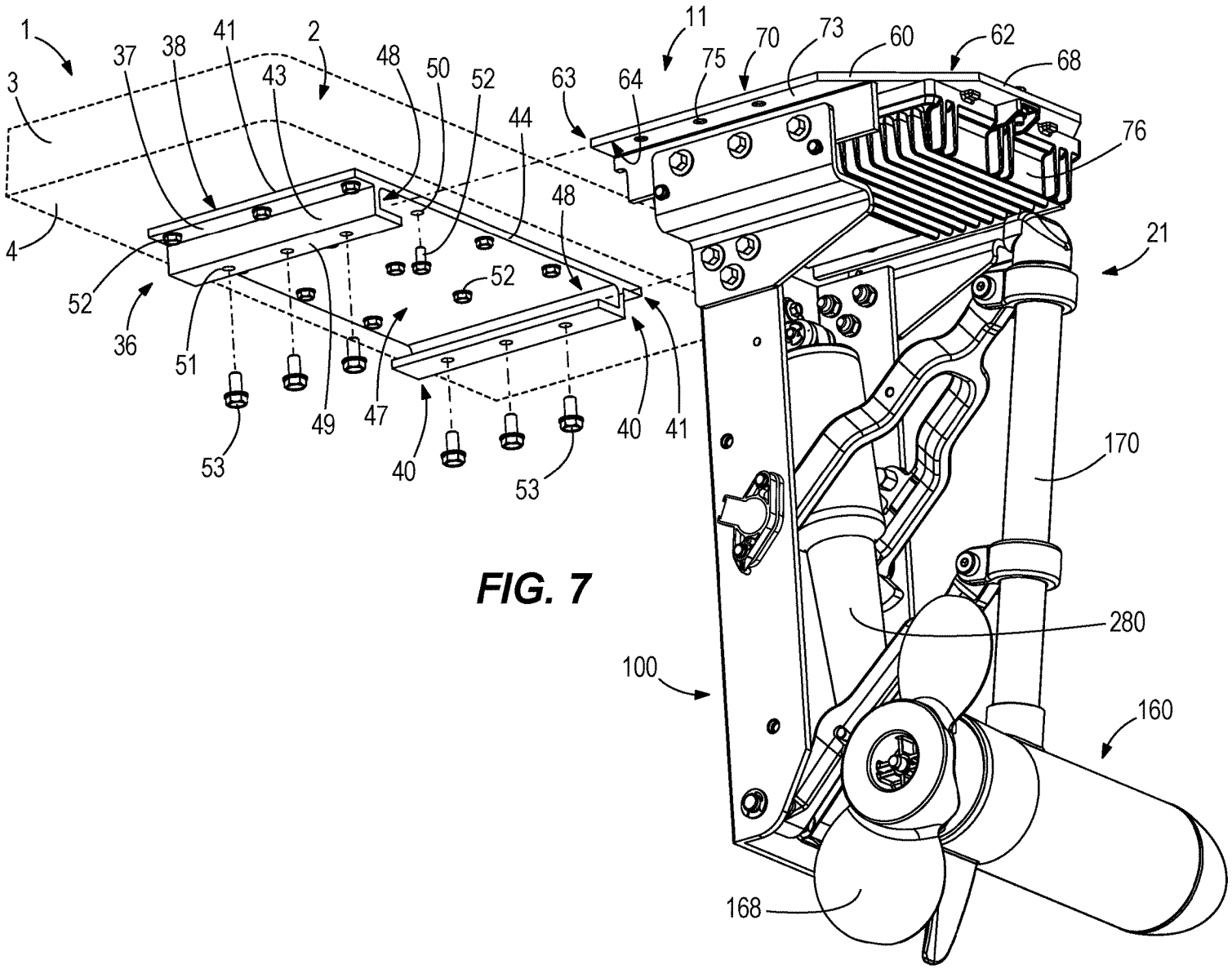
FIG. 7. is a rear perspective view of the device of FIG. 6 with a support frame removed from a mounting bracket.

With continued reference to FIG. 2, side extensions 71 extend downwardly from the top 62 of the carriage 60. A bracket 78 couples the carriage 60 to the second portion 100 of the base 20. In particular, openings are defined through the bracket 78 through which fasteners 74 may extend to couple the bracket 78 to the carriage 60 (here via the side extensions 71) and to the second portion 100. In this manner, the second portion 100 is slidable with the carriage 60 within the mounting bracket 36. The carriage 60 and the second portion 100 are together also referred to as a support frame 21 (FIGS. 6-7).

Returning to FIG. 2, the second portion 100 extends between a top 102 and a bottom 104, a front 106 and a back 108, and sides 110 therebetween. The second portion 100 has a front plate 112 with side extensions 122 that extend rearwardly therefrom. A shackle plate 114 having arms 116 is coupled to front plate 112 via methods presently known in the art, such as using fasteners, welds, and/or rivets. An axle opening 124, pin opening 128, and lock opening 129 are defined within the side extension 122, as discussed further below. The terms "axle," "pin," and "lock" with respect to the openings described above are used to distinguish between these features and are non-limiting on the components configured to be received therein.

Figure 3:
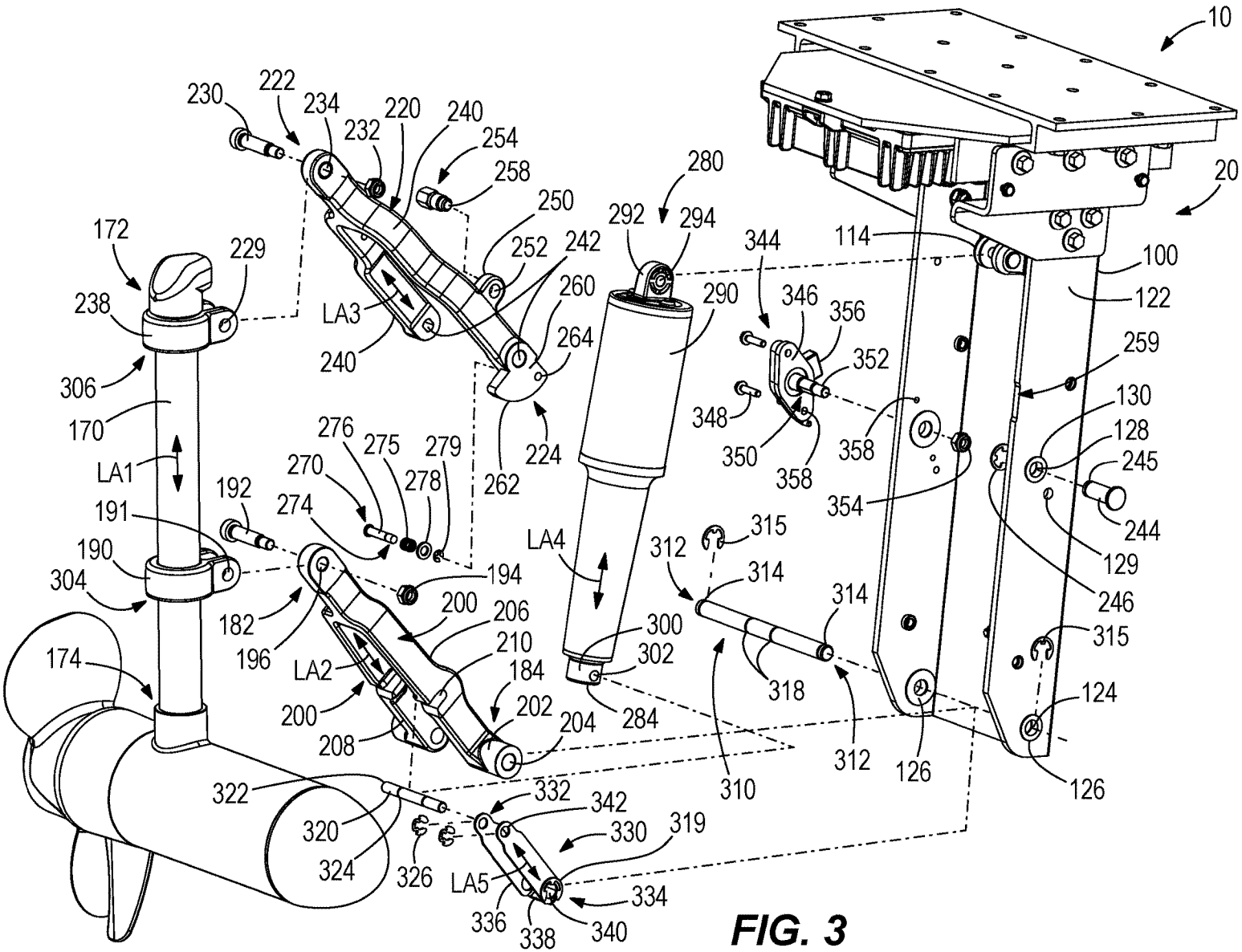
FIG. 3 is an exploded view of FIG. 2.

With reference to FIGS. 2 and 3, the propulsion device 10 includes a shaft 170 that extends between a first end 172 and second end 174 defining a length access LA1 therebetween. The propulsor 160 is coupled to the second end 174 of the shaft 170, particularly at an extension collar 166 extending from a body 164 of the propulsor 160. Power and communication are provided to propulsor 160 by a wire extending through the shaft 170. The wire (not expressly shown) exits the shaft 170 through a wire gasket 176 positioned at the first end 172, which prevents water and debris ingress into the shaft 170.

A pivot arm 180 extends between a neck at a first end 182 and a second end 184, defining a length axis LA2 therebetween. The pivot arm 180 is pivotally coupled to a first location 304 on the shaft 170 via a clamp 190 defining openings 191 therein. The first end 182 of the pivot arm 180 is coupled to the clamp 190 via a fastener that extends through the opening 191 in the clamp and an opening 196 at the first end 182, shown here as a bolt 192 and nut 194. It should be recognized that other types of fasteners are also anticipated by the present disclosure, including axles, pins, and/or the like.

With continued reference to FIGS. 2 and 3, the pivot arm 180 divides into opposing fork segments 200 as the pivot arm 180 extends from the first end 182 to the second end 184. The opposing fork segments 200 each have an upper edge 206 and a lower edge 208. An opening 210 is provided through the opposing fork segments 200, here open to the lower edges 208 thereof. Barrels 202 extend outwardly from each of the opposing fork segments 200 at the second end 184 of the pivot arm 180 with openings 204 provided at least partially into the barrels 202 (shown here to extend entirely therethrough).

The openings 204 are configured to receive an axle 310 therein or therethrough. The axle 310 shown extends linearly between opposing ends 312 (FIG. 3) with a pair of outer grooves 314 recessed into the axle 310 near to the opposing ends 312, and inner grooves 318 also recessed into the axle 310 closer to a midpoint thereof. The pivot arm 180 is pivotally coupled to the base 20 via the axle 310 extending through the axle opening 124 in the base 20 as well as through the openings 204 and the opposing fork segments 200. The axle 310 is axially retained within the base 20 via retaining rings 315 received within the outer grooves 314.

The propulsion device 10 or FIGS. 2 and 3 also includes a secondary arm 220 extending from a neck at a first end 222 to a second end 224 defining a length axis LA3 therebetween. An opening 234 is defined within the first end 222 of the secondary arm 220. The secondary arm 220 is coupled to a second location 306 of the shaft 170 via a clamp 228 in a similar manner to the clamp 190 discussed above. A bolt 230 is received through the opening 234 in the first end 222 and through and opening 229 in the clamp 228, which is threadedly engaged with a nut 232. However, it should be recognized that other types of fasteners may also be used to couple the secondary arm 220 to the shaft 170, including cotter pins, press-fit pins, rivets, and/or other commercially available hardware.

Similar to the pivot arm 180, the secondary arm 220 divides between the first end 222 to the second end 224 into opposing fork segments 240 each defining an opening 242 at the second end 224. However, it should be recognized that the present disclosure also contemplates pivot arms 180 and/or secondary arms 220 that do not divide at the corresponding second ends 184, 224 into opposing fork segments 200, 240, respectively. The secondary arm 220 is pivotally coupled to the base 20 via fasteners received through the pin opening 128 in the base 20 and through the openings 242 in the opposing fork segments 240, shown here as a pin 244 defining a groove 245 therein for receiving a retaining ring 246 similar to the axle 310. As discussed above, fasteners other than pins are also contemplated by the present disclosure, including nuts and bolts, rivets, and/or the like.

With continued reference to FIGS. 2 and 3, the propulsion device 10 further includes an actuator 280 that extends from a mounting tab at a first end 292 to a second end 284. The actuator 280 presently shown is a linear actuator having a housing 290 with a rod 300 that extends and retracts therefrom along a length axis LA4. An opening 294 is provided at the first end 292 the actuator 280 and is configured to receive a fastener 115 therethrough (FIG. 2) to pivotally couple the actuator 280 to the shackle plate 114 of the base 20. Similarly an opening 302 is provided within the rod 300 at the second end 284 of the actuator 280. In this manner, the distance between the first end 292 and second end 284 in the actuator 280 varies via actuation of the actuator 280, which is discussed below causes movement of the shaft 170 between the stowed and deployed position.

The shaft 170 attached to the propulsor 160 is removably coupled to the actuator 280 via a fastener engageable between the actuator 280 and the pivot arm 180. The fastener, shown here as shaft 320, extends between opposing ends 322 with grooves 324 recessed into the shaft 320. The shaft 320 extends through the opening 302 in the rod 300 of the actuator 280, shown here to extend perpendicularly from the length axis LA4 thereof. As shown in FIG. 2, the shaft 320 is received within the opening 210 in the opposing fork segments 200 of the pivot arm 180. In certain embodiments, the shaft 320 has a press-fit arrangement with the opening 210 such that moving the shaft 320 from the lower edge 208 to the upper edge 206 of the opposing fork segments 200 causes the shaft 320 to be seated within the opening 210.

The press-fit arrangement is further shown in FIG. 6, whereby the shaft 320 has a diameter D3 that generally corresponds to a diameter D1 of the opening 210 nearest the upper edge 206 of the pivot arm 180, but the shaft 320 must first pass through a narrowed diameter D2 of the opening 210 when moving upwardly from the lower edge 208. This configuration provides that the actuator 280 prevents the shaft 170 from being moved manually when the shaft 320 is engaged within the opening 210 in this press-fit arrangement, but the shaft 320 can be disengaged from the opening 210 by applying a pre-determined force separating the shaft 320 from the pivot arm 180, as discussed further below.

A shown in FIG. 3, the propulsion device 10 further includes an engagement arm 330 that extends from a first end 332 to a second end 334 forming a length axis LA5 therebetween. In the embodiment shown, the engagement arm 330 includes opposing engagement members 336 coupled by a base 338. However, it should be recognized that configurations of engagement arms 330 having greater or fewer engagement members are also contemplated by the present disclosure, including having a single engagement arm. Openings 340 are provided near the second end 334 of the opposing engagement members 336, as well as openings 342 near the first end 332. The openings 340 near the second end 334 are configured to receive the axle 310 therethrough, whereby the axle 310 also extends through the openings 210 in the opposing fork segments 240 of the pivot arm 180 as discussed above. Retaining clips 319 are received within the inner grooves 318 of the axle 310 to maintain the axial position of the engagement arm 330 relative to the axle 310. The engagement arm 330 is approximately centered along the length of the axle 310 such that the opposing engagement members 336 of the engagement arm 330 are sandwiched between the rod 300 and the actuator 280 and the opposing fork segments 200 of the pivot arm 180.

Similarly, the shaft 320 discussed above is received through the openings 342 in the first ends 332 of the opposing engagement members 336. The opposing engagement member 336 are again retained in axial position relative to the shaft 320 via engagement of retaining rings 326 within the grooves 324 recessed into the shaft 320. In this manner, the engagement arm 330 is pivotable at its second end 334 relative to the base 20, and also pivotally coupled to the rod 300 of the actuator 280 such that actuation of the actuator 280 causes pivoting of the engagement arm 330. This ensures that the shaft 320 follows an arc about the axle 310 to ensure alignment between the shaft 320 and the opening 210 in the opposing fork segments 200 of the pivot arm 180.

Figure 4:
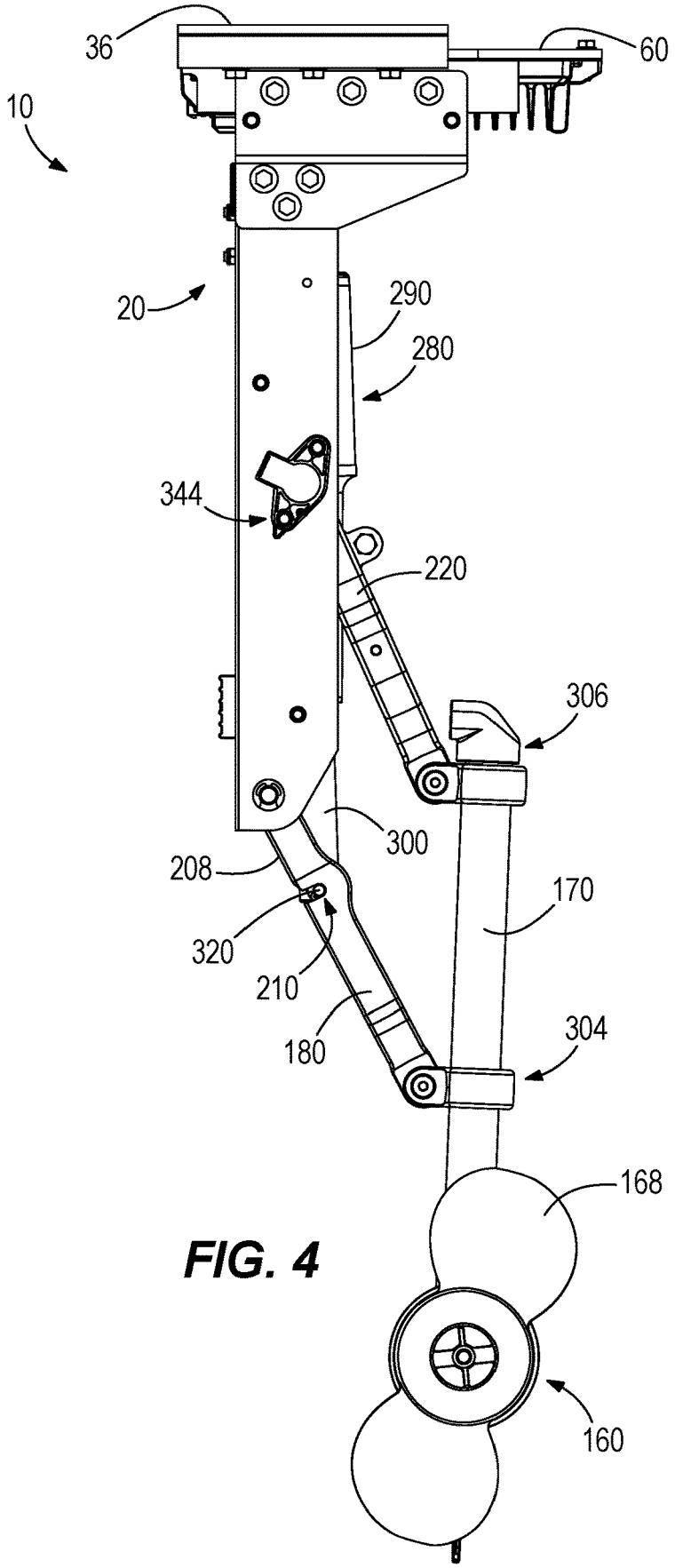
FIG. 4 is a left view of the embodiment of FIG. 1 in a fully deployed position.
Figure 5:
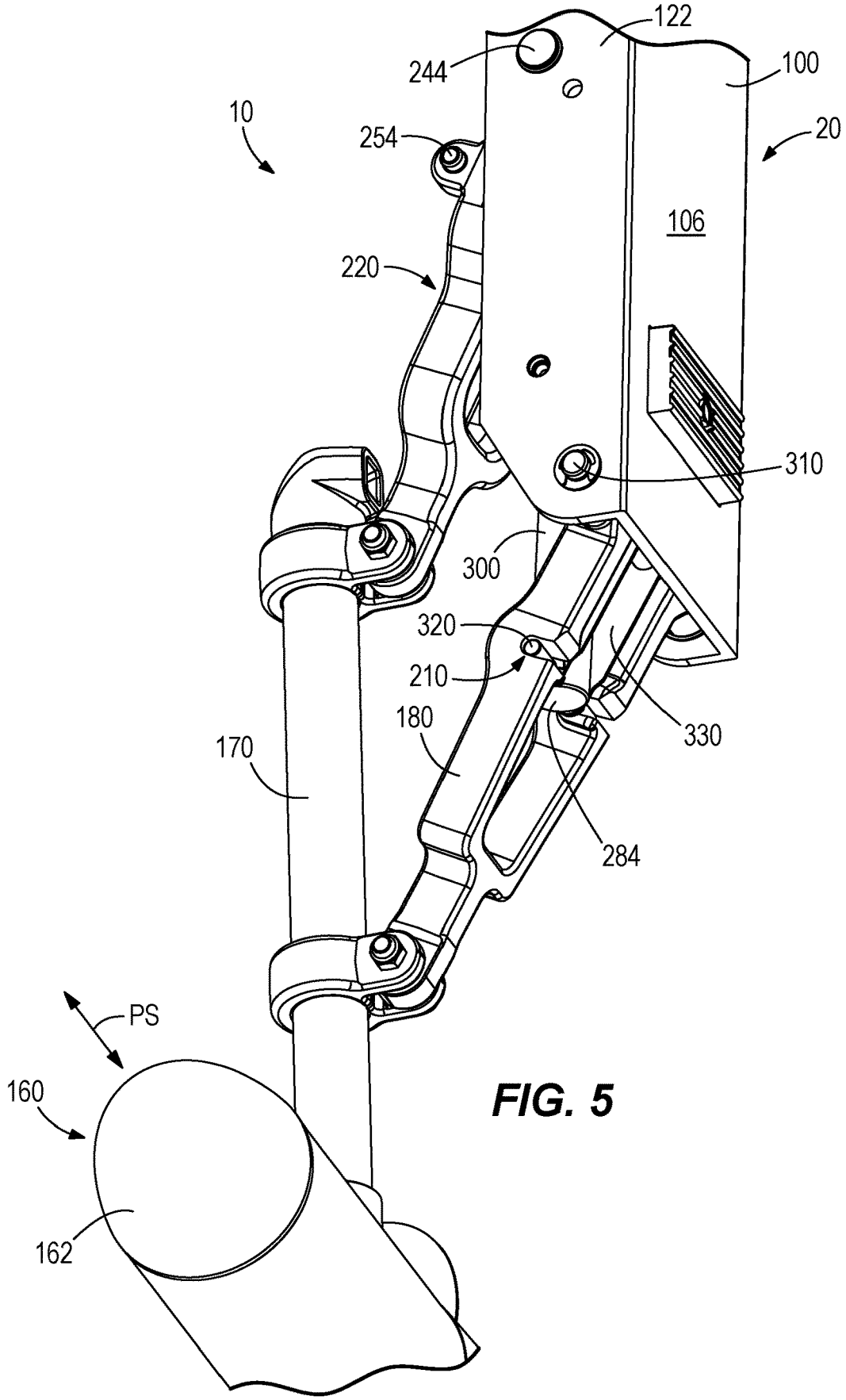
FIG. 5 is a close-up front perspective view of the embodiment shown in FIG. 4.

FIGS. 4 and 5 shows the propulsion device 10 in a fully deployed position, whereby the actuator 280 has extended the rod 300 away from the housing 290, and whereby engagement of the shaft 320 between the rod 300 and the pivot arm 180 causes pivoting of the pivot arm 180 and, consequently, movement of the shaft 170. In the embodiment shown, the propulsor 160 is configured to propel the marine vessel 1 in the port-starboard direction PS.

As discussed in part above, the present disclosure further relates to devices and methods of making devices for coupling propulsors to a marine vessel. In particular, the present inventors have recognized that propulsors presently known in the art are heavy and cumbersome to handle, rendering installation on a marine vessel difficult to accomplish accurately, safely, and consistently. This may be particularly challenging in the context of a pontoon boat, whereby the propulsor is to be coupled to the underside 4 of the deck 3 (see FIG. 1).

Additional details are now provided for depict an exemplary device 11 for coupling a propulsor 160 to a marine vessel 1 according to the present disclosure. As shown in FIGS. 6 and 7, the device 11 includes a mounting bracket 36 such as that discussed above, which extends between a top 38 and a bottom 40, and also between a front and a back 44. The mounting bracket 36 includes a plate 47 (FIG. 7) with C-channels 48 extending downwardly therefrom. In particular, the C-channels 48 are formed by sides 43 that extend downwardly from the plate 47, with floors 49 extending from the sides 43 to form a C shape with between the plate 47, sides 43, and floor 49.

With reference to FIG. 7, flanges 37 are formed at the sides 41 of the plate 47 outside the position of the C-channels 48. Openings 50 extend through the flanges 37, which allows the mounting bracket 36 to be coupled to the underside 4 of the deck 3 of the marine vessel 1 using fasteners 52, such as bolts, screws, and/or other fasteners present known in the art. It should be recognized that the mounting bracket 36 may also be integrally formed with the deck 3 or fixed thereto via other methods known in the art, such as rivets or welding, for example. Similarly, the floors 49 of the C-channels 48 each have openings 51 therethrough, which are configured to receive fasteners 53 therein in a similar or same manner as the openings 50 and fasteners 52 discussed above.

As discussed above, the carriage 60 is coupled to the second portion 100 to together form a support frame 21 onto which the propulsor 160 is coupled. The support frame 21 is therefore coupled to the marine vessel 1 via engagement between of the carriage 60 within the C-channels 48 of the mounting bracket 36. In particular, the carriage 60 has flanges 73 configured to slide within the C-channels 48, bounded from above by the plate 47 of the mounting bracket 36 on top, from the sides 70 of the carriage 60 by the sides 43 of the C-channels 48, and supported from below by the floors 49 of the C-channels 48.

Openings 75 are provided through the flanges 73, which are configured to receive the fasteners 53 discussed above with respect to the openings 51 in the C-Channels 48. The fasteners 53 fix the carriage 60 to the mounting bracket 36 by preventing the carriage 60 from sliding along the floors 49 of the C-channels 48. In certain examples, the openings 51 and/or the openings 75 are threaded to correspond to threads on the fasteners 53 such that when the carriage 60 is received within the mounting bracket 36, the carriage 60 is removably coupled thereto by threaded engagement of the fasteners 53 through the openings 51 and 75.

In this manner, the mounting bracket 36 is configured to support the mass of the support frame 21 and all elements coupled (e.g., the propulsor 160) thereto via engagement between the carriage 60 and the mounting bracket 36, specifically via its C-channels 48. This allows an operator to simply slide the support frame 21 into position within the mounting bracket 36, at which point the mounting bracket 36 handles the mass. In other words, there is no concern for aligning the openings 51 in mounting bracket 36 with the openings 75 in the carriage 60, nor engaging fasteners therethrough, while also having to maintain the load of the support frame 21. Now with the weight of the support frame 21 supported by the mounting bracket 36, and thus by the marine vessel 1, the operator may simply slide the carriage 60 within the mounting bracket 36 until the openings 51 and 75 are aligned, then insert the fasteners 53 to secure the support frame 21 relative to the marine vessel 1 in the fore-aft direction. In certain examples, 6061-T6 aluminum is used to ensure sufficient strength for the mounting bracket 36 and/or support frame 21.

It should be recognized that any number of openings and fasteners may be used to couple the mounting bracket 36 to the marine vessel 1, and the carriage 60 to the mounting bracket 36. Likewise, leading corners 63 (FIG. 7) of the carriage 60 may be chamfered or rounded to aid in the operator aligning the carriage 60 between the C-channels 48 while supporting the load of the support frame 21.

It should further be recognized that other configurations for engagement between the carriage 60 and mounting bracket 36 are also contemplated by the present disclosure. For example, the mounting bracket 36 may have one or more T-brackets extending downwardly therefrom, each engageable by a pair of C-channels on the carriage 60. Likewise, with reference to the mounting bracket 36 of FIG. 7, alternate configurations of channels are also contemplated, including those in which the sides 43 and/or floor 49 are not perpendicular to the plate 47 and/or each other.

With reference to FIG. 6, the front 106 of the support frame 21 may further include a bumper 370, such as rubber, plastic, or other resilient materials, which is positioned between the front 106 of the support frame 21 and the back 6 of the pontoon 5 (see FIG. 1) when the carriage 60 is in the fixed position shown in FIGS. 1 and 6. The bumper 370 prevents damage and/or objectionable sound between the support frame 21 and the marine vessel 1 if the support frame 21 moves during operation of the propulsor 160, other propulsion devices, and/or when the marine vessel 1 is transported on a trailer, for example.

FIG. 6 also shows a first electrical connection 360 provided on the front 106 of the support frame 21, which in the present example provides power and communication to the propulsion device 10 for stowing and deploying the propulsor 160, operating the propulsor 160, and such or other functions provided by the propulsion device 10 (including communication with sensors). This first electrical connection 360 is configured to be electrically coupled to a second electrical connector 362, which may be part of a wire harness 364 that leads to the helm of the marine vessel 1, for example. The inventors have identified that it is particularly advantageous to position the second electrical connector 362 on the back 6 of the pontoon 5 (FIG. 1) such that sliding the support frame 21 (particularly the carriage 60) within the mounting bracket 36 into its fixed or coupled position automatically seats the first electrical connection 360 with the second electrical connector 362. This eliminates an additional step in the installation and deinstallation process, also avoiding a risk of unintentional damage if the support frame 21 is removed from the mounting bracket 36 without first disconnecting any electrical connections to the propulsion device 10.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A device for coupling a propulsor to a marine vessel, the device comprising:

a mounting bracket configured to be coupled to an underside of the marine vessel;

a carriage coupled to the propulsor and configured to slide horizontally into the mounting bracket into a fixed position, wherein the propulsor is coupled to the carriage so as to be moveable relative to the carriage between stowed and deployed positions, and wherein the propulsor is closer to the mounting bracket when the shaft is in the stowed position than in the deployed position; and a member engageable to prevent the carriage from sliding out of the fixed position;

wherein the propulsor is coupled to the marine vessel by sliding the carriage into the fixed position and engaging the member, and wherein the propulsor is decoupled from the marine vessel by disengaging the member and sliding the carriage out of the mounting bracket.

2. The propulsor according to claim 1, wherein the mounting bracket comprises two C-channels positioned such that the carriage is slidable therein and therebetween.

3. The propulsor according to claim 1, wherein the carriage has a rectangular side profile that engages with the mounting bracket to prevent rotation of the carriage within the mounting bracket.

4. The propulsor according to claim 1, wherein the carriage and the propulsor have a mass when coupled together, and wherein the mass is supported above from the mounting bracket.

5. The propulsor according to claim 1, where the member is a fastener, and wherein the carriage is fixed in the fixed position by the fastener extending through the carriage and into the mounting bracket.

6. The propulsor according to claim 1, wherein the marine vessel is a pontoon boat comprising a deck and pontoons that extend between bow and stern ends, and wherein the mounting bracket is configured to be coupled to the deck behind the stern end of one of the pontoons.

7. The propulsor according to claim 1, wherein a shaft couples the propulsor to the carriage.

8. The propulsor according to claim 7, further comprising an actuator operable to move the shaft between the stowed and deployed positions.

9. The propulsor according to claim 8, further comprising a cover coupled to the carriage, wherein the actuator is contained within the cover when the shaft is in the stowed position.

10. The propulsor according to claim 9, wherein the shaft is at least partially uncontained by the cover when the shaft is in the stowed position.

11. A device for coupling a propulsor to a marine vessel having a deck and a pontoon that extends between a bow end and a stern end, the device comprising:

a mounting bracket configured for attachment to an underside of the marine vessel aft of the stern end of the pontoon;

a support frame having a carriage, wherein the support frame further comprises a plate that extends downwardly from the carriage and is configured to support the propulsor, wherein the carriage is slidable horizontally into the mounting bracket into a fixed position; and a member engageable to prevent the carriage from sliding out of the fixed position;

wherein the propulsor is coupled to the marine vessel by sliding the carriage into the fixed position and engaging the member, and wherein the propulsor is decoupled from the marine vessel by disengaging the member and sliding the carriage out of the mounting bracket.

12. A method for coupling a propulsor to a marine vessel having a pontoon that extends from a bow end to a stern end, the method comprising:

coupling a mounting bracket to an underside of the marine vessel behind the stern end of the pontoon;

horizontally sliding a carriage into the mounting bracket into a fixed position, wherein the carriage is configured to support the propulsor from the mounting bracket by sliding the carriage into the fixed position; and engaging a member so as to prevent the carriage from sliding out of the fixed position;

wherein the propulsor is decouplable from the marine vessel by disengaging the member and sliding the carriage out of engagement with the mounting bracket.

13. The method according to claim 12, wherein the marine vessel comprises a deck, further comprising coupling the mounting bracket to an underside of the deck.

14. The method according to claim 12, further comprising coupling the propulsor to the support frame via a shaft, and further comprising configuring an actuator to move the shaft relative to the carriage between stowed and deployed positions, wherein the propulsor is closer to the mounting bracket when the shaft is in the stowed position than in the deployed position.

15. The device according to claim 1, wherein the mounting bracket is configured to be coupled to the marine vessel while the member is disengaged for sliding the carriage out of the mounting bracket.

16. The device according to claim 1, wherein the carriage slides in the mounting bracket horizontally to be vertically supported thereby.

17. The device according to claim 16, wherein the member is engaged vertically from below the mounting bracket.

18. The device according to claim 2, wherein the member extends through at least one of the two C-channels when engaged to prevent the carriage from sliding out of the mounting bracket.

19. The method according to claim 12, wherein the mounting bracket is coupled to the marine vessel before the carriage is slid into the mounting bracket.

* * * * *